US005695364A

United States Patent [19]

Nitta

[11] Patent Number: 5,695,364

[45] Date of Patent: Dec. 9, 1997

[54] CONNECTOR MEMORY FOR AN IC MEMORY CARD WITH A SMALL THICKNESS

[75] Inventor: Kunihiro Nitta, Tokyo, Japan

[73] Assignee: Japan Aviation Electronics Industry, Limited, Tokyo, Japan

[21] Appl. No.: 601,822

[22] Filed: Feb. 15, 1996

Related U.S. Application Data

[63] Continuation of Ser. No. 249,399, May 26, 1994, abandoned.

[30] Foreign Application Priority Data

Jun. 2, 1993 [JP] Japan ..... 5-131946

[51] Int. Cl.[6] ..... H01R 13/40

[52] U.S. Cl. ..... 439/595; 439/660

[58] Field of Search ..... 439/59, 62, 64, 439/70–72, 152–160, 328, 329, 377, 595, 660

[56] References Cited

U.S. PATENT DOCUMENTS

| | | | |
|---|---|---|---|
| 4,204,737 | 5/1980 | Faber et al. | 439/377 |
| 4,653,823 | 3/1987 | Burson et al. | 439/64 |
| 5,155,663 | 10/1992 | Harase | 439/928 |
| 5,225,968 | 7/1993 | Ma | 439/377 |
| 5,297,966 | 3/1994 | Brennian, Jr. et al. | 439/377 |

FOREIGN PATENT DOCUMENTS

| | | |
|---|---|---|
| 55-43676 | 10/1980 | Japan . |
| 61-176081 | 7/1986 | Japan . |

*Primary Examiner*—J. J. Swann

*Attorney, Agent, or Firm*—Laff, Whitesel, Conte & Saret, Ltd.

[57] ABSTRACT

Preferably for use in an IC memory card, a connector member (1) is for connection to a counterpart connector and comprises a plurality of contacts (5) and an insulator block (3) insulating the contacts and used as a guide frame (30) for guiding a fitting portion of the counterpart connector with the insulator block provided with an engaging portion (33) for engaging the fitting portion when the counterpart connector is connected to the connector member. More particularly, the engaging portion comprises a beam (40) resiliently supported by each edge block wall of the guide frame and a protrusion (41) for engaging a notch formed in the fitting portion when the fitting portion is received along the guide frame.

8 Claims, 6 Drawing Sheets

CONNECTOR MEMORY FOR AN IC MEMORY CARD WITH A SMALL THICKNESS

This application is a continuation of application Ser. No. 08/249,399, filed May 26, 1994, now abandoned.

BACKGROUND OF THE INVENTION

This invention relates to a connector member, in particular, a connector member for connection to a counterpart connector as an I/O (input/output) connector comprising an IC memory card. The IC memory card may be a modem card, an LAN card, and so on for use in an external communication.

It is desirable for such a connector that a click is felt when connection to the counterpart is established. In the manner which will later be described more in detail, such connectors are already known. For example, a conventional connector is disclosed in Japanese Utility Model Publication (Y2) No. 43,676 of 1980, wherein its housing is equipped on an outside wall with a friction locking portion. Another conventional connector is disclosed in Japanese Patent Prepublication (A) No. 176,081 of 1986. The connector connects a first connector element to a second connector element. The connector is covered with a cover having a pair of side surfaces. A resilient locking portion is attached to each of the side surfaces.

It should, however, be noted that the connector of the Utility Model Prepublication is bulky because the friction locking portion must move in the direction of the thickness of the connector. As a result, this connector is inadequate for use as the I/O connector for the IC memory card. As for the connector of the Patent Prepublication, the resilient locking portion sometimes clings to a cable connected to the connector so that the resilient locking portion or the cable may be injured. The foregoing is because the resilient locking portion is projected outside from the cover.

SUMMARY OF THE INVENTION

It is consequently an object of this invention to provide a connector member having a thin thickness so as to be applicable to an IC memory card connector.

It is another object of this invention to provide a connector member which is of the type described and which can reliably give a click feeling when connection is established between the connector member and a counterpart connector.

Other objects of this invention will become clear as the description proceeds.

According to this invention, there is provided a connector member for connection to a counterpart connector with the connector member and the counterpart connector disposed in a predetermined direction of connection. The connector member comprises a plurality of contacts extending in the predetermined direction and an insulator block insulating the contacts from one another. The counterpart connector has a connector end and comprises a fitting portion protruded in the predetermined direction from the connector end. According to this invention, the connector member is characterized in that the insulator block is used as a guide frame for guiding the fitting portion and comprises an engaging portion for engaging the fitting portion when the counterpart connector is connected to the connector member to establish electric connection between the contacts and the fitting portion.

DESCRIPTION OF THE PREFERRED EMBODIMENT

Figure 1:
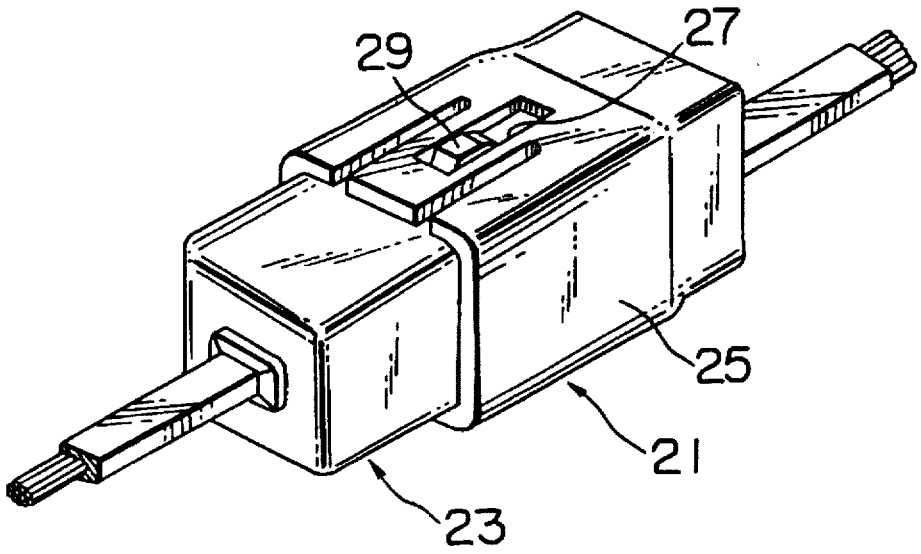
FIG. 1 PRIOR ART
FIG. 1 is a perspective view of a conventional connector.

Referring now to FIG. 1, a conventional connector will be described in order to facilitate an understanding of the present invention. This connector is described in the Utility Model Prepublication mentioned heretobefore. The connector comprises a first or female connector element 21 for receiving a second or male connector element 23 in a predetermined direction. The female connector element 21 has an outside wall 25 with a friction locking hole 27 formed on its upper surface. The male connector element 23 is provided with a friction protrusion 29 in correspondence to the friction locking hole 27. On connecting the male and the female connector elements 21 and 23 to each other, the male connector element 23 is inserted in the predetermined direction into the female connector element 21. In the meantime, the friction protrusion 29 is pushed into the friction locking hole 27 with a click. This connector is bulky.

Figure 2:
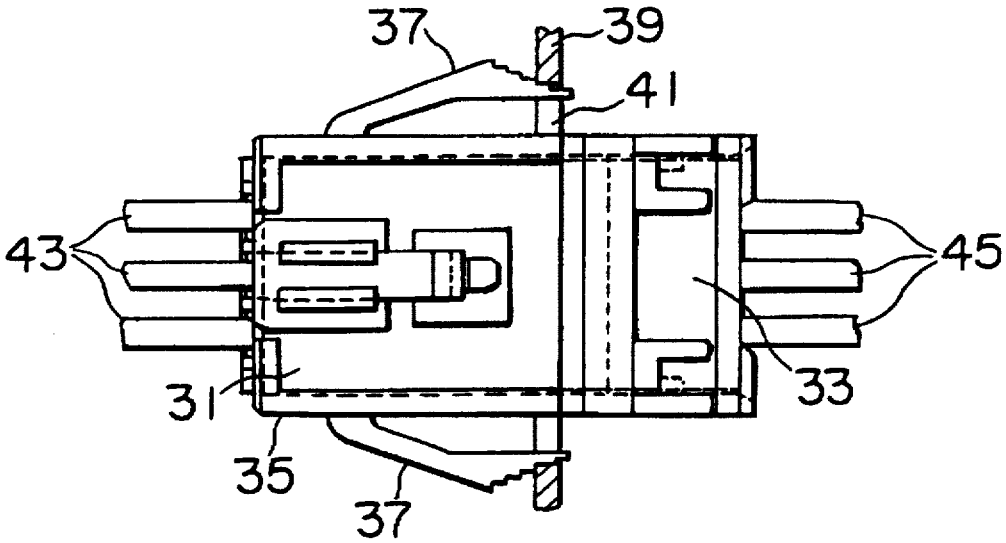
FIG. 2 PRIOR ART
FIG. 2 is a perspective view of another conventional connector.

Turning to FIG. 2, another conventional connector will be described. This connector is described in the Patent Prepublication mentioned hereinabove. The connector connects a first connector element 31 for a printed circuit board (later depicted) to a second or relaying connector element 33. The first connector element 31 and the second connector element 33 are covered with a cover 35 having a pair of side surfaces. A resilient locking portion 37 is attached to each of the side surfaces. Such resilient locking portions 37 are for mounting the connector on a panel 39 having an opening 41 defined by panel edges. Cables 43 and 45 are attached to the first connector element 31 and the second connector element 33. Since the resilient locking portions 37 are protruded from the side surfaces, the cable 43 or 45 sometimes clings to the resilient locking portions 37.

Figure 3:
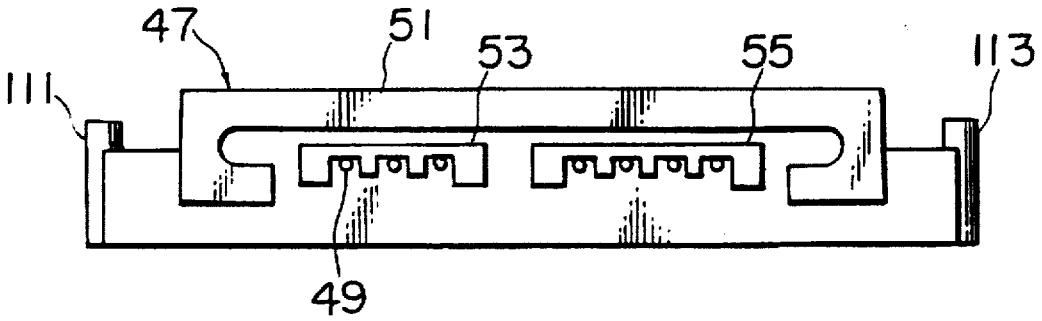
FIG. 3 is a much simplified front view of a connector member according to an embodiment of this invention.
Figure 4:
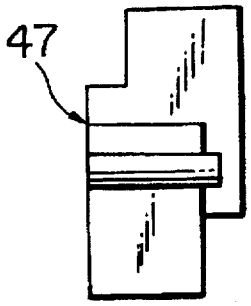
FIG. 4 is a right side view of the connector member depicted in FIG. 3.

Referring afresh to FIGS. 3 and 4, description will proceed to a connector member according to a preferred embodiment of this invention. The connector member is for an IC memory card (later illustrated) and is for connection to a counterpart connector which will later be described.

As best shown in FIG. 3, the connector member comprises an insulator block 47 and a plurality of connector member contacts 49. Insulating the contacts 49 from one another, the insulator block 47 has a bottom surface and comprises a guide frame 51, a first contact holder 53, and a second contact holder 55. The first and the second contact holders 53 and 55 are collectively called a contact holder depending on the circumstances.

The guide frame 51 is of a generally C shape in vertical section and defines a member receiving void having a front and a bottom opening.

Figure 5:
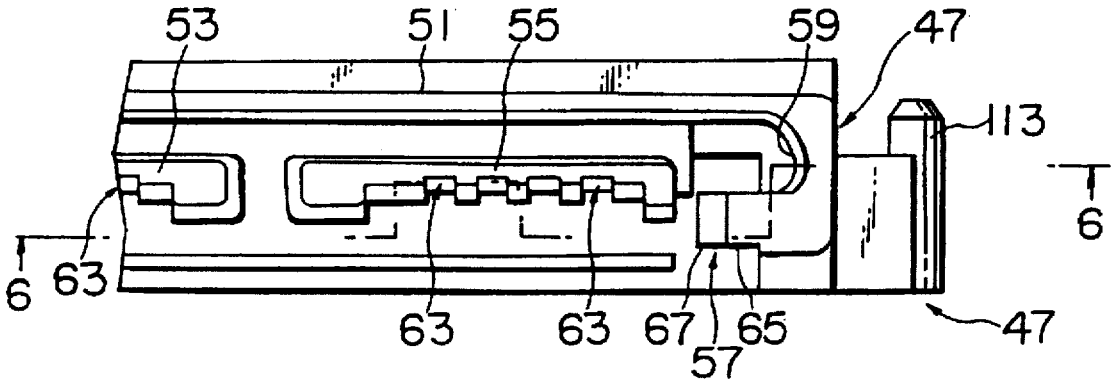
FIG. 5 is an enlarged partial front view of the connector member depicted in FIG. 3.

FIG. 5 will additionally be referred to. For connection to the counterpart connector, the insulator block 47 comprises an engaging portion 57 and has a guide surface 59 for receiving a fitting portion 61 (later described) of the counterpart connector. Incidentally, the guide frame 51 may be formed in an elongate circular shape without the bottom opening so as to have only the front opening.

The first contact holder 53 is placed in the member receiving void of the guide frame 51 so as to be enclosed with the frame 51 and has a generally plate shape parallel to the bottom surface on a left side of the figure. The first contact holder 53 has three contact receiving indents for receiving three of the contacts 49, respectively.

Similarly, the second contact holder 55 has four contact receiving indents for receiving four of the contacts 49. Unlike the first contact holder 53, the second contact holder 55 is for holding a different number of contacts 49. This is in order to prevent an erroneous connection of the connector element to the counterpart connector. Furthermore, the first and the second contact holders 53 and 55 define a keyway therebetween.

Figure 6:
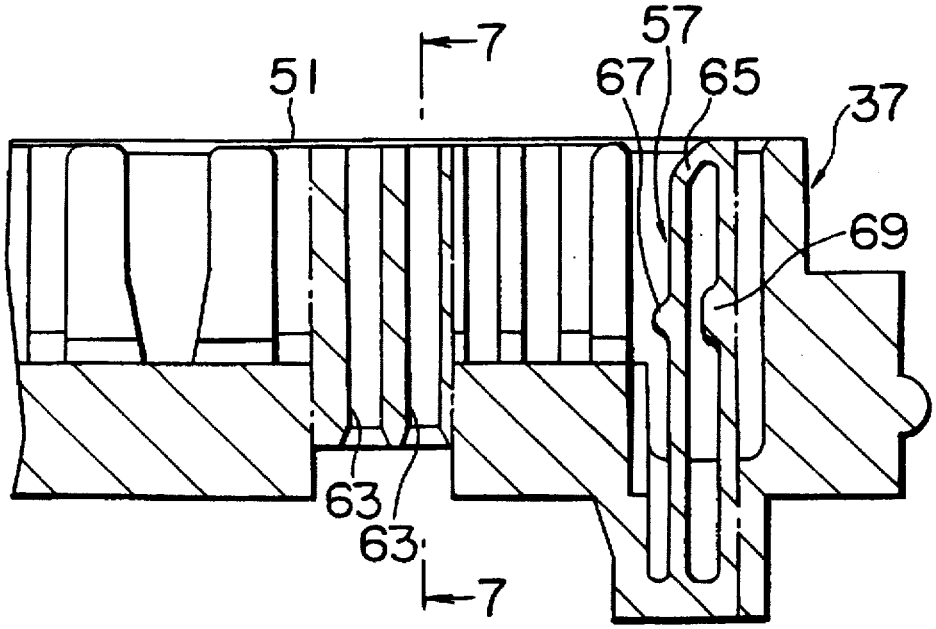
FIG. 6 is a sectional view of the connector member taken on a dash-dot line 6—6 depicted in FIG. 5.
Figure 7:
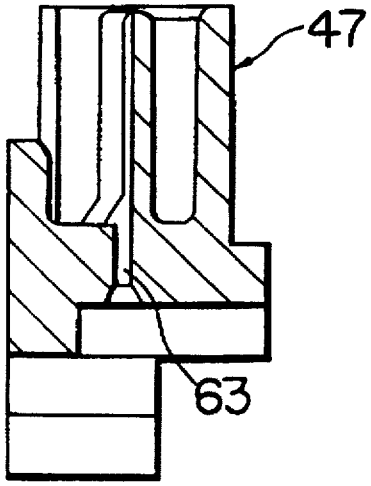
FIG. 7 is a sectional view of the connector member taken on a dash-dot line 7—7 depicted in FIG. 6.

As best shown in FIGS. 6 and 7, the insulator block 47 has a rear end depicted bottomwardly of the figures. It should be noted that the word "bottom" is here used in a manner which is different from that described above in conjunction with FIGS. 3 and 5. Three contact holes 63 are formed through the insulator block 47 to reach the rear end and in communication with the contact receiving indents of the first contact holder 53. Likewise, four contact holes are formed in communication with the contact receiving indents of the second contact holder 55 and are designated by the reference numeral 63. The contacts 49 are pushed into the contact holes 63.

As shown in FIGS. 3 and 5, the guide frame 51 comprises a main block wall having the guide surface 59 and a pair of edge block walls inwardly extended from the main block wall. The pair of edge block walls have edge wall ends or end surfaces substantially parallel to the predetermined direction. The edge block walls define an inter-wall space at the bottom opening when the guide frame 51 is formed in the generally C shape. The engaging portion 57 is formed at least on one of the edge wall ends.

In FIG. 5, each of the edge block walls comprises a block wall member inwardly extended from the main block wall and a resilient beam 65 supported by the block wall member. The block wall member has one of the edge wall members and a protrusion 67 inwardly extended from the one of edge wall ends. The beam 65 with the protrusion 67 serves as the engaging portion 57. The beam 65 is supported on its both ends by top and bottom edge wall ends inwardly extended in each edge wall end. Alternatively, the beam 65 may be fixed on only its one end in a cantilever fashion. In either event, the beam 65 and the edge wall ends define an elongated space parallel to the predetermined direction. The protrusion 67 is protruded from an intermediate center position of the beam 65 into the inter-wall space.

In the manner illustrated in FIG. 6, the block wall member comprises a boss 69 protruded from the elongated space so as to be directed to the protrusion 67. When the counterpart connector is inserted into the connector member, the boss 69 serves as an abutment in the manner which will later be described.

Figure 8:
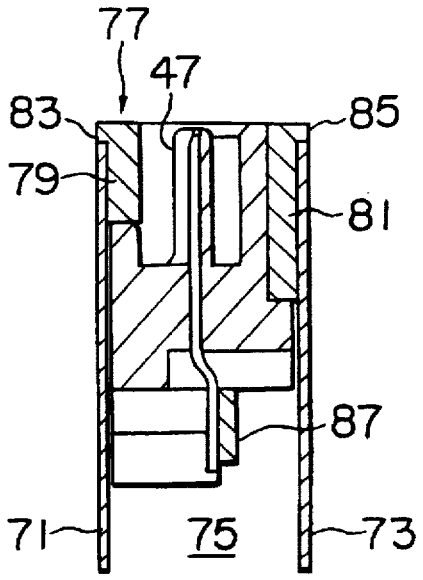
FIG. 8 is a sectional view, taken like FIG. 7, of an IC connector containing the connector member depicted in FIGS. 3 to 7.

Referring afresh to FIG. 8, the above-mentioned connector member is used in an IC memory card comprising a framework. In the framework, a pair of opposing cover panels or plate members 71 and 73 are parallel to the predetermined direction and define a member receiving void 75 for receiving the connector member, particularly, the insulator blocking 47.

The IC memory card has a predetermined thickness in a thickness direction perpendicular to the predetermined direction. In order to define the member receiving void 75, a reception frame 77 is added to the opposing cover panels 71 and 73 so that the reception frame 77 has in the thickness direction an outside plate dimension equal to the thickness. The reception frame 77 has a free end of the connector member and the predetermined thickness. Since the predetermined thickness is prescribed in Japan Electronics Industry Development Association (JEIDA) and Personal Computer Memory Card International Association (PCMCIA) Standards, the IC memory card need to have the predetermined thickness equal to 5 mm.

Figure 9:
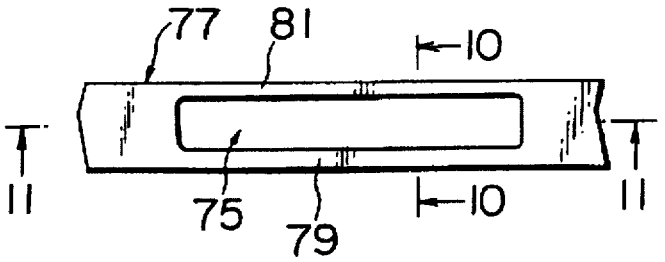
FIG. 9 is a front view of a framework illustrated in FIG. 8.
Figure 10:
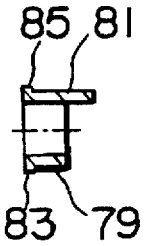
FIG. 10 is a sectional view of the framework taken on a dash-dot line 10—10 depicted in FIG. 9.
Figure 11:
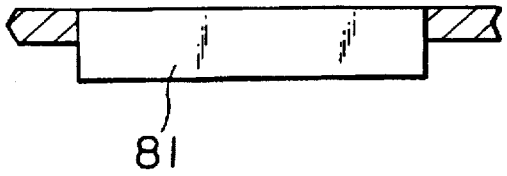
FIG. 11 is a sectional view of the framework taken on a dash-dot line 11—11 depicted in FIG. 9.

As shown in FIGS. 9 to 11, the reception frame 77 is received in the member receiving void 75 near the top of FIG. 8 and comprises a first joint portion 79 and a second joint portion 81. To be coplanar with the cover panel 71, the first joint portion 79 is formed with a first stopper 83 protruded outwardly from its rim. The first joint portion 79 has a first predetermined depth in the predetermined direction. Similarly, the second joint portion 81 is formed with a second stopper 85 having a second predetermined depth in the predetermined direction. The first predetermined depth is smaller than the second predetermined depth.

Figure 12:
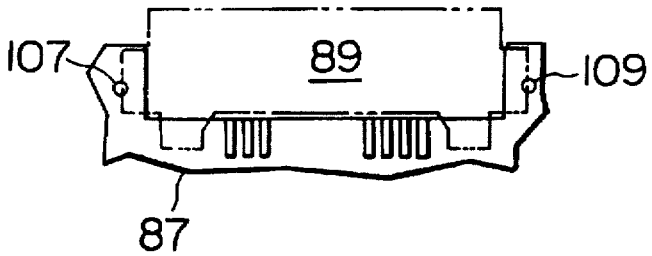
FIG. 12 is a partial back view of a printed circuit board of the IC connector illustrated in FIG. 8.

Referring afresh to FIG. 12 and again to FIG. 8, the IC connector comprises a printed circuit board 87 for connection of the contacts 49 (FIG. 3). To receive the printed circuit board 87, a board receiving portion 89 is formed in the insulator block 47 depicted in FIGS. 3 to 7. The printed circuit board 87 is depicted also in FIG. 8.

Figure 13:
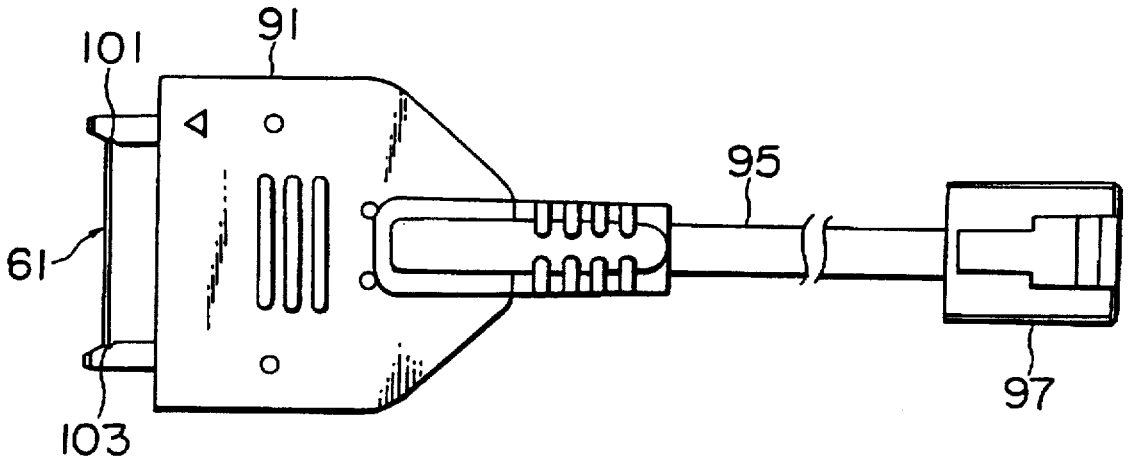
FIG. 13 is a top view of a counterpart connector for connection to the connector member illustrated in FIGS. 3 to 7.
Figure 14:
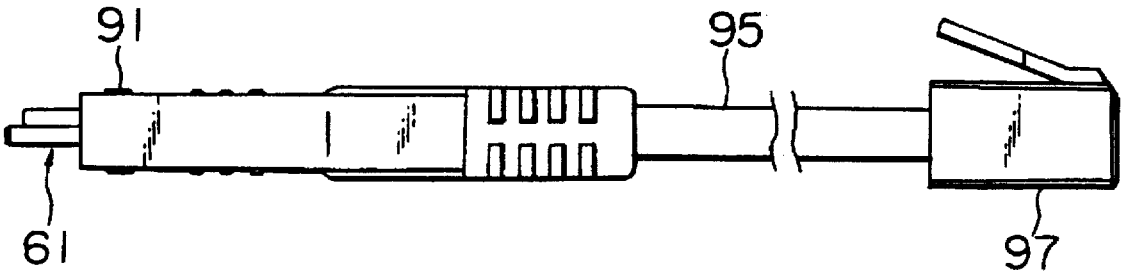
FIG. 14 is a side view of the counterpart connector shown in FIG. 13.
Figure 15:
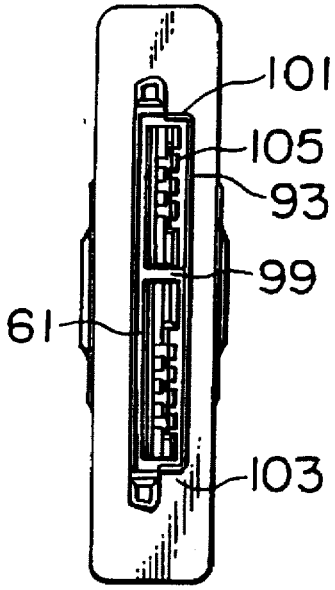
FIG. 15 is a front view of the counterpart connector illustrated in FIG. 13.

Referring now to FIGS. 13 to 15, the counterpart connector is for connection, in the predetermined direction of connection, to the connector member described in the foregoing. The counterpart connector comprises a connector hood 91, its insulator block 93 enclosed with the connector hood 91 and having a connector end, a cable 95 extending outwardly of the connector hood 91, and a modular plug 97. The above-described fitting portion 61 of the counterpart connector is outwardly protruded in the predetermined direction from the connector end of the insulator block 93. The counterpart connector further comprises a key 99 protruded from the insulator block 93 adjacent to the fitting portion 61. The key 99 is received in the keyway described in conjunction with FIGS. 3 and 5 when the connector end of the insulator block 93 is brought into contact with the free end of the reception frame 77 to connect the counterpart connector to the connector member.

The fitting portion 61 has a pair of outwardly indented notches 101 and 103 for engaging with the protrusions 67 (FIG. 6) of the connector member when the fitting portion 61 is guided along the main block wall to connect the counterpart connector to the connector member. At the same time, the connector member is brought into contact with the connector end of the counterpart connector with a click.

The above-mentioned counterpart insulator block 93 rigidly holds a plurality of counterpart contacts 105 for establishing electric connection to the contacts 49 (FIG. 3) of the connector member. Through the counterpart insulator block 93 and the cable 95, the counterpart contacts 105 are connected to the modular plug 97.

Referring again to FIG. 12, the printed circuit board 87 has a pair of positioning holes 107 and 109 formed for positioning to the connector member of FIGS. 3 to 7 when the connector member receives the printed circuit board 87 in the board receiving portion 89. This correct positioning is also in order to prevent the printed circuit board 87 from breaking by a result of its bending.

Referring once more to FIGS. 3, 5, 8, and 12, the insulator block 47 has first and second positioning protrusions 111 and 113 extended on both ends. On assembling, the first and the second positioning protrusions 111 and 113 are received in the positioning holes 107 and 109 of the printed circuit board 87, respectively.

Reviewing FIGS. 5, 6, and 13 through 15, the engaging portion 57 is engaged with the fitting portion 61 when the counterpart connector is connected to the connector member to establish electric connection between the connector member contacts 49 and the counterpart connector contacts 105. At the same time, the fitting portion 61 pushes the protrusion 67 into the elongated space between the resilient beam 65 and the block wall member. When the notch 101 or 103 is continuously guided to reach the free end, the notch 101 or 103 does not abut the protrusion 67 so that the resilient beam 65 immediately regains its original position depicted in FIG. 6. Since the notch 101 or 103 knocks against the protrusion 67 with an appreciable click, a user can easily confirm connection for the connector member to the counterpart connector.

While this invention has thus far been described in specific conjunction with a preferred embodiment thereof, it will now be readily possible for one skilled in the art to put this invention into effect in various manners. For example, a snap-action switch may be used as the engaging portion 57 with the clock.

What is claimed is:

1. A connector member for making a connection to a counterpart connector with said connector member and said counterpart connector being disposed in a predetermined direction of connection, said connector member comprising a plurality of contacts extending in said predetermined direction and an insulator block for insulating said contacts from one another, said counterpart connector having a connector end and comprising a fitting portion protruding in said predetermined direction from said connector end, said insulator block also forming a guide frame for guiding said fitting portion and comprising an engaging portion for engaging said fitting portion when said counterpart connector is connected to said connector member to establish an electric connection between said contacts and said fitting portion; said connector member being a framework used on an IC memory card, said framework defining a member receiving void for receiving said connector member; said guide frame comprising a main block wall for guiding said fitting portion and a pair of edge block walls extending inwardly from said main block wall to have edge wall ends substantially parallel to said predetermined direction and to define an inter-wall space between said edge wall ends, each of said edge block walls comprising said engaging portion; and said framework covering said inter-wall space when said connector member is received in said member receiving void.

2. A connector member as claimed in claim 1, wherein:

each of said edge block walls comprises a block wall member inwardly extended from said main block wall and a beam resiliently supported by said block wall member and having one of said edge wall ends and a protrusion inwardly extended from said one of edge wall ends, said beam with said protrusion serving as said engaging portion;

said fitting portion having a notch for engaging said protrusion when said fitting portion is guided along said main block wall to connect said counterpart connector to said connector member.

3. A connector member as claimed in claim 2, wherein said block wall member and said beam define an elongated space parallel to said predetermined direction, said block wall member having a boss protruded into said elongated space.

4. A connector member as claimed in claim 3, said connector member having a free end brought into contact with said connector end when said fitting portion is guided along said main block wall to connect said counterpart connector to said connector member, wherein said beam is a cantilever resiliently supported by said block wall member along said free end.

5. A connector member as claimed in claim 1 wherein said insulator block comprises a contact holder spaced apart from said main block wall to define a portion receiving space relative to said main block wall for receiving said fitting portion when said counterpart connector is connected to said connector member, said contact holder holding said contacts insulated from one another in groups and substantially equally intra-group spaced on a plane parallel to said predetermined direction.

6. A connector member for connection to a counterpart connector with said connector member and said counterpart connector being disposed in a predetermined direction of connection, said connector member comprising a plurality of contacts extending in said predetermined direction and an insulator block for insulating said contacts from one another, said counterpart connector having a connector end and comprising a fitting portion protruding in said predetermined direction from said connector end, said insulator block also forming a guide frame for guiding said fitting portion and comprising an engaging portion for engaging said fitting portion when said counterpart connector is connected to said connector member to establish an electric connection between said contacts and said fitting portion, said connector member being in an IC memory card framework, said framework defining a member receiving void for receiving said connector member;

said guide frame comprising a main block wall for guiding said fitting portion and a pair of edge block walls inwardly extended from said main block wall to have edge wall ends substantially parallel to said predetermined direction and to define an inter-wall space between said edge wall ends, each of said edge block walls comprising said engaging portion;

said framework covering said inter-wall space when said connector member is received in said member receiving void, said insulator block further comprising a contact holder spaced apart from said main block wall to define a portion receiving space relative to said main block wall for receiving said fitting portion when said counterpart connector is connected to said connector member, said contact holder holding said contacts insulated from one another in groups and substantially equally intra-group spaced on a plane parallel to said predetermined direction;

said contact holder further comprising first and second contact holders, said first contact holder holding a first number of contacts, said second contact holder holding a second number of contracts, said first and said second numbers of contacts being said plurality of contacts, said first and said second contact holders defining a keyway;

said counterpart connector comprising a key protruding adjacent to said fitting portion in said predetermined direction from said connector end; and said keyway receiving said key when said contact end is brought into contact with said free end to connect said counterpart connector to said connector member.

7. A connector member for connection to a counterpart connector with said connector member and said counterpart connector being disposed in a predetermined direction of connection, said connector member comprising a plurality of contacts extending in said predetermined direction and an insulator block for insulating said contacts for one another, said counterpart connector having a connector end and comprising a fitting portion protruding in said predetermined direction from said connector end, said insulator block also forming a guide frame for guiding said fitting portion and comprising an engaging portion for engaging said fitting portion when said counterpart connector is connected to said connector member to establish an electric connection between said contacts and said fitting portion, said connector member being used in an IC memory card comprising a framework, said framework defining a member receiving void for receiving said connector member;

said guide frame comprising a main block wall for guiding said fitting portion and a pair of edge block walls inwardly extended from said main block wall to have edge wall ends substantially parallel to said predetermined direction and to define an inter-wall space between said edge wall ends, each of said edge block walls comprising said engaging portion;

said framework covering said inter-wall space when said connector member is received in said member receiving void;

said IC memory card having a predetermined thickness in a thickness direction which is perpendicular to said predetermined direction, said framework comprising a reception frame having a free end and said thickness and front and back plate members being attached to said reception frame with a predetermined member distance spaced apart to define said member receiving void and to have in said thickness direction an outside plate dimension equal to said thickness;

said insulator block having front and back block faces and comprising a front block wall having a front block wall having a front wall face coplanar with said front block face and a front block wall end defining said inter-wall space in cooperation with said edge wall ends;

said main block wall having a main block wall end protruding from said front block wall end and comprising a back block was having a back wall face recessed from said back block face to define a back recess and a pair of side block walls extending substantially in said thickness direction from said back block wall and extending to said edge block walls;

said reception frame comprising a front frame member having a front frame face attached to said front plate member, said free end, and a front opposite end and a back member having said free end and a back frame face attached to said back plate member; and said front block wall end abutting said front opposite end with said back block wall guided along said back frame member for reception of said back frame member in said back recess when said insulator block is received in said member receiving void with said inter-wall space covered with said front frame member.

8. A connector member for making a connection to a counterpart connector with said connector member and said counterpart connector being disposed in a predetermined direction of connection, said connector member comprising a plurality of contacts extending in said predetermined direction and an insulator block for insulating said contacts from one another, said counterpart connector having a connector end with a marginal end and comprising a fitting portion protruding in said predetermined direction from said connector end except for said marginal end, said insulator block also forming a guide frame for guiding said fitting portion, said guide frame having a guide frame end defining an insulator block end for abutting on said marginal end, said insulator block further comprising a click-type resilient engaging portion for engaging said fitting portion to form a frictional grasping hook when said counterpart connector is clickingly connected to said connector member with said guide frame end abutting on said marginal end to establish an electric connection between said contacts and said fitting portion whereby said frictional grasping hook keeps its original shape when said guide frame receives said fitting portion.

* * * * *